US005150894A

United States Patent [19]

Ricciardi

[11] Patent Number: 5,150,894

[45] Date of Patent: Sep. 29, 1992

[54] DIVERTER MECHANISM FOR FLAT DOCUMENT CONVEYOR SYSTEM

[75] Inventor: Mario Ricciardi, Glenview, Ill.

[73] Assignee: Bell & Howell Company, Skokie, Ill.

[21] Appl. No.: 676,157

[22] Filed: Mar. 27, 1991

[51] Int. Cl.[5] ..... B65H 39/10

[52] U.S. Cl. ..... 271/302; 271/179; 271/199; 271/207; 271/303

[58] Field of Search ..... 271/179, 176, 199, 207, 271/220, 300, 302, 303

[56] References Cited

U.S. PATENT DOCUMENTS

| | | | |
|---|---|---|---|
| 2,815,949 | 12/1957 | Faeber | 271/302 |
| 3,199,673 | 8/1965 | Flint | 209/699 |
| 3,469,836 | 9/1969 | Javid | 271/303 |
| 3,472,506 | 8/1967 | Rabinow et al. | 271/304 |
| 3,724,657 | 4/1973 | Katagiri et al. | 271/302 X |
| 4,441,702 | 4/1984 | Nagel et al. | 271/179 X |
| 4,601,396 | 7/1986 | Pavie | 209/569 |
| 4,687,106 | 8/1987 | Prins | 271/262 X |
| 4,729,282 | 3/1988 | Kasdorf | 271/302 X |
| 4,785,942 | 11/1988 | Van Leijenhorst et al. | 271/303 X |
| 4,974,826 | 12/1990 | Svyatsky et al. | 271/179 |

*Primary Examiner*—Joseph E. Valenza
*Assistant Examiner*—Tuan N. Nguyen
*Attorney, Agent, or Firm*—Welsh & Katz, Ltd.

[57] ABSTRACT

A conveyor system for conveying generally flat documents on-edge includes a primary conveyor belt defining a primary conveyor path, and at least one secondary conveyor belt defining a diverter station and having a first reach disposed in juxtaposed relation to a reach of the primary conveyor belt and a second reach inclined to the primary conveyor belt so as to establish an open span along the primary conveyor belt immediately downstream from the juxtaposed belt reaches. A document diverter mechanism includes pairs of guide arms selectively movable between first positions operative to guide a document along the open span of the primary conveyor belt after exiting the juxtaposed belt reaches, and second positions operative to divert a document from the primary conveyor path and guide the diverted document along the inclined reach of the secondary conveyor belt to a stacking station. A kicker arm assembly is operative to orient diverted documents at the stacker station for sweeping into a container.

27 Claims, 4 Drawing Sheets

DIVERTER MECHANISM FOR FLAT DOCUMENT CONVEYOR SYSTEM

BACKGROUND OF THE INVENTION

The present invention relates generally to conveyor systems for conveying flat documents on-edge, and more particularly to a belt type conveyor system having a novel diverter mechanism selectively operable to divert a document from a main conveyor path to an alternate conveyor path, such as into a stacking bin or receptacle assembly.

Conveying systems are generally known which convey documents, such as mailing envelopes and the like, on-edge along a primary or main path from which the documents may be selectively diverted or sorted according to predetermined criteria such as their particular mailing zone destination. The primary conveyor paths of such systems are generally defined at least in part by a rectilinear vertically disposed reach of a primary endless conveyor belt. One or more document diverter or sorter stations are supported along the length of the primary conveyor belt, and each includes a secondary conveyor belt having a reach inclined to the primary conveyor path and along which a document travels when diverted from the primary conveyor path.

Various techniques are known to divert documents from a primary conveyor path into a secondary or diverter conveyor path or route towards a stacking assembly. See, for example, U.S. Pat. No. 3,724,657 which employs a switching roller disposed transverse to a primary conveyor belt and movable to push the primary belt in a direction to cause a document to deviate from the primary or main conveyor path to a secondary or branch route. Another technique for diverting documents from a primary conveyor path to one or more alternate paths or routes is to employ pivotally mounted diverting vanes such as disclosed in U.S. Pat. No. 4,601,396.

A significant drawback in known document conveying systems having means to divert documents being conveyed on-edge along a primary conveying path is that such systems do not work well when conveying relatively thick flat documents which provide substantial resistance to bending. The present invention overcomes this drawback in known document conveying systems by providing a document conveying system having a diverter mechanism capable of efficiently and rapidly diverting relatively thick flat documents from a primary conveying path to a secondary path inclined to the primary path.

Another drawback found in prior document conveying systems is their inability to effectively move an on-edge document laterally from a conveyor belt to enable sweeping of the document from a stacking bin into a receiving container. For example, where a document is diverted from a primary conveyor path to a secondary conveyor path and conveyed on-edge to a station where the diverted document is inserted into a receiving container, the secondary path may be inclined to the direction the document undergoes as it is passed into the container. In this situation, it is desirable that successive documents be reoriented into a plane transverse to the direction the documents undergo as they are passed or swept into the receiving container. The present invention addresses this problem by providing a novel kicker arm operative to engage the trailing end of a document disposed on an inclined conveyor belt at the stacker station so as to effect lateral movement of the document away from the inclined path and into a sweeper mechanism which conveys the document into a receiving container.

SUMMARY OF THE INVENTION

One of the primary objects of the present invention is to provide a novel diverter mechanism for use in a document conveying system, which diverter mechanism finds particular application in diverting relatively inflexible flat documents from a primary conveyor path to a secondary conveyor path inclined to the primary conveyor path.

In carrying out the present invention, a novel diverter mechanism is provided for use in a document conveying system which includes a primary conveyor belt and at least one secondary conveyor belt having a reach juxtaposed to the primary conveyor belt to effect movement of a document on-edge along a primary conveyor path. The secondary conveyor belt also has a reach inclined to the primary conveyor path and defines a secondary or diverter conveyor path to receive a document diverted from the primary conveyor path. The diverter mechanism is disposed adjacent the juxtaposed primary and secondary belt reaches and includes a first pair of guide arms which carry a belt-engaging roller disposed transverse to the primary conveyor belt. The guide arms and roller are pivotal in response to a command signal to move both juxtaposed reaches of the primary and secondary conveyor belts so as to change the direction of the primary conveyor path and reduce the angle of inclination between the inclined reach of the secondary belt and the primary conveyor path. In this manner, a relatively stiff flat document being conveyed between the juxtaposed reaches of the primary and secondary conveyor belts may be caused to undergo an initial change in direction while remaining firmly engaged between the belts. As the diverted document approaches the inclined reach of the secondary conveyor belt, it engages the pivoted first pair of guide arms which guide the diverted document onto the inclined reach of the secondary conveyor belt and prevent fishtailing of the trailing edge of the document.

A second pair of guide arms carries a roller disposed transverse to and biased against the secondary conveyor belt to establish the juxtaposed reach with the primary conveyor belt. The second pair of guide arms is normally disposed to guide a non-diverted document through an open span of the primary conveyor path after the document leaves the juxtaposed belt reaches of the corresponding diverter station. Pivotal movement of the first pair of guide arms to initiate diversion of a document from the primary conveyor path effects a corresponding pivotal movement of the second pair of guide arms to a position enabling bending of the diverted document by the first pair of guide arms and guidance along the inclined reach of the secondary conveyor belt to a stacking station where the document may be swept into a receiving container.

Thus, a more particular object of the present invention is to provide a novel diverter mechanism for a document conveying system having primary and secondary conveyor belt reaches disposed in juxtaposed relation and defining a portion of a primary conveyor path, the secondary conveyor belt having a reach inclined to the primary conveyor belt and along which a diverted document is guided to a stacking station. The diverter mechanism includes first and second pairs of guide arms movable in response to command signals between first positions operative to guide a document along an open span of the primary conveyor belt, and second positions operative to guide a diverted document onto and along the inclined reach of the secondary conveyor belt. A feature of the diverter mechanism as aforedescribed lies in providing a roller between each pair of guide arms so that the rollers transversely engage opposite sides of the juxtaposed reaches of the primary and secondary conveyor belts. Pivotal movement of the first pair of guide arms in response to a command signal initiates lateral movement of the primary conveyor belt which effects a corresponding movement of the secondary conveyor belt while a document is engaged between the juxtaposed belt reaches. The diverted belt and pivotal guide arms guide the document onto the inclined reach of the secondary belt and prevent its trailing edge from deflecting or fishtailing away from the inclined reach when the diverted document has fully exited the juxtaposed belt reaches of the primary and secondary conveying belts.

In accordance with a further object of the present invention, a third conveyor belt is provided having a reach cooperative with the inclined reach of the secondary conveyor belt to receive a diverted document for transfer to a stacker assembly. A kicker arm assembly is operative to "kick" the trailing end of a document laterally away from the third conveyor belt and onto an auger which initiates sweeping of the document into a document receiving container.

Further objects, features and advantages of the present invention, together with the organization and manner of operation thereof, will become apparent from the following detailed description of the invention when taken in conjunction with the accompanying drawings wherein like reference numerals designate like elements throughout the several views.

DETAILED DESCRIPTION

Figure 1:
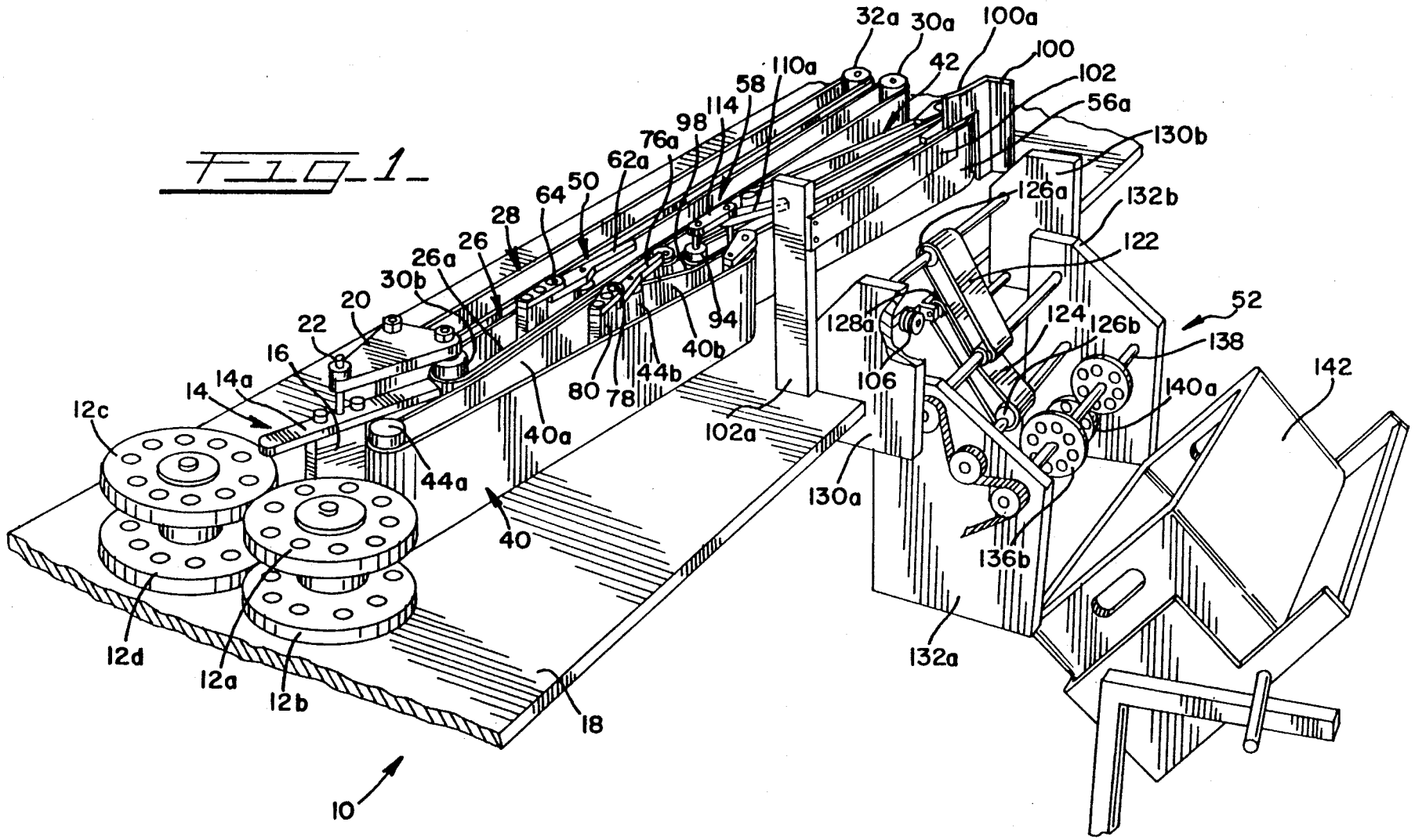
FIG. 1 is a fragmentary perspective view illustrating a document conveying system having diverter mechanism in accordance with the present invention.
Figure 2:
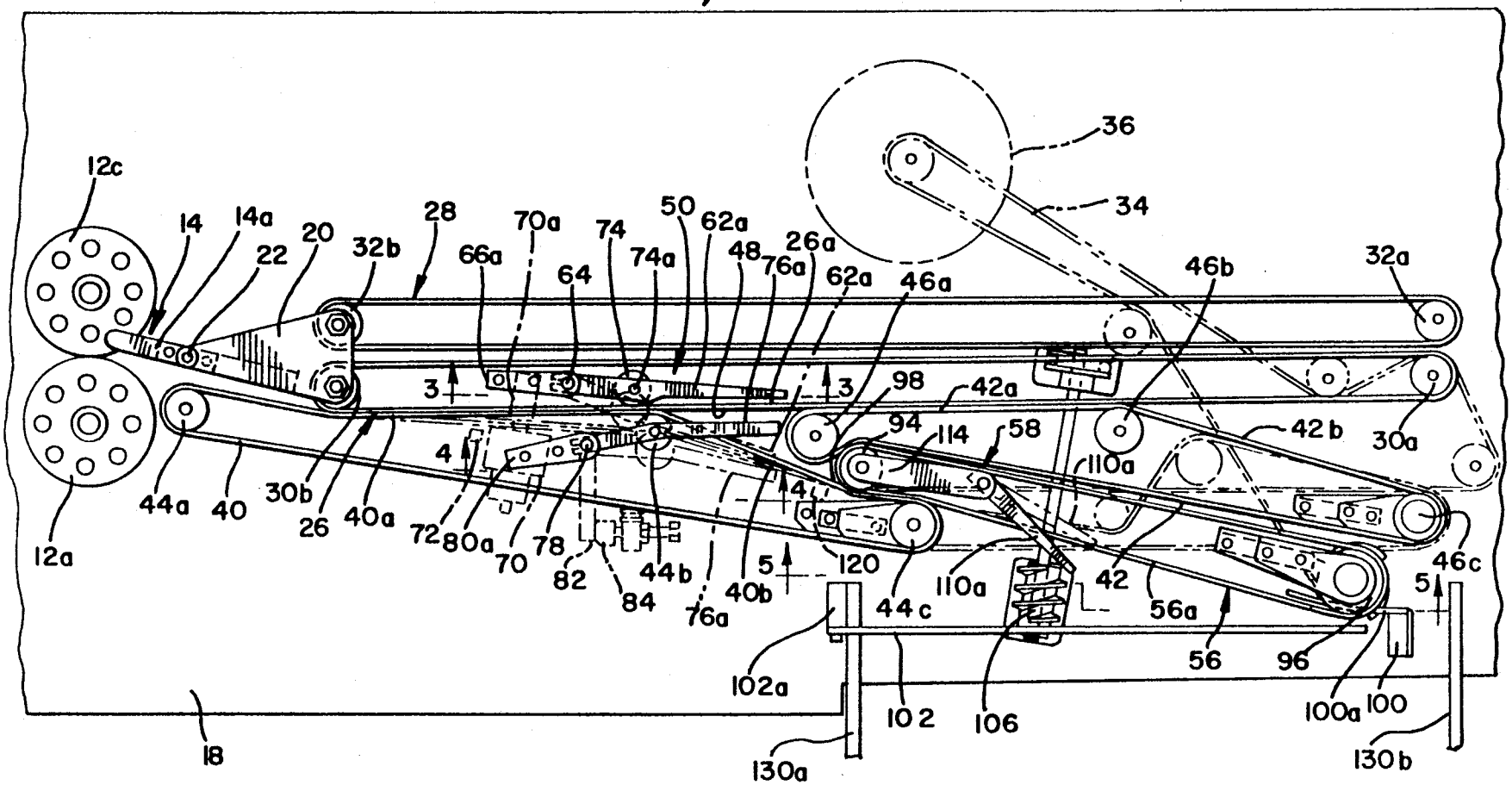
FIG. 2 is a plan view of the document conveying system illustrated in FIG. 1 but with a modified sweeping station being partially shown.

Referring now to the drawings, and in particular to FIGS. 1 and 2, a document conveying system constructed in accordance with the present invention is indicated generally at 10. The document conveying system 10, which may alternatively be termed a document processing system, may form a portion of a larger system for processing flat documents, such as postal envelopes and letters and the like, which includes a feeder station (not shown) from which documents are fed in an on-edge one-at-a-time sequence to a reader station (not shown). The reader station includes an optical character reader or bar code reader operative to read indicia on the individual documents, such as printed addresses or conventional bar codes, representative of a mailing zip code destination. As will be described, the illustrated document conveying system 10 represents a portion of one side of a document sorter station having a pair of substantially parallel primary or main document conveying paths along each of which are positioned a plurality of diverter stations and stacker assemblies. The reader station creates a command signal for each successive document which determines the primary conveying path along which each successive document will travel, and also determines the particular diverter station at which the document will be diverted from the corresponding primary conveying path to a document stacking station having a receiving receptacle in which the diverted documents are stacked for subsequent handling.

The document conveying system 10 finds particular application in handling and sorting on-edge documents that are relatively thick, such as up to three-eighths inch thick, and relatively stiff or inflexible. Such documents offer substantial resistance to bending transversely of their direction of travel through the conveying system and therefore require more positive guidance as they are diverted from a primary conveying path to a secondary diverting or sorting path inclined to the primary path and along which the diverted documents are conveyed to a stacker station or the like. The illustrated embodiment of the document conveying system 10 is particularly adapted for sorting documents of approximately $8\frac{1}{2} \times 11$ inch size. However, with component size modifications as necessary, the system 10 may also be employed to sort conventional letter size envelopes.

The document conveying system 10 includes accelerator and conveyor path selector means in the form of two pairs of rotatably driven accelerator rollers 12*a,b* and 12*c,d* which define a nip therebetween to receive successive flat on-edge documents from the reader station. A document directing gate 14 is supported immediately downstream from the accelerator rollers and includes a pair of parallel gate arms, one of which is shown at 14*a*, secured to opposite ends of a spacer bar 16 which is pivotally supported between a base plate 18 and an upper support plate 20 by a pivot shaft 22. The gate arms are pivotal about the vertical pivot axis 22 by actuator means (not shown) responsive to command signals from the reader station to selectively direct successive documents from the accelerator rollers 12*a–d* to either of two main or primary parallel conveying paths defined by endless primary conveying belts indicated generally at 26 and 28. The primary conveyor belts 26 and 28 are supported by corresponding pairs of vertical axis rotatable rollers 30*a,b* and 32*a,b* of equal diameter, with one roller of each pair, such as 30*a* and 32*a*, being rotatably driven. In the illustrated embodiment, roller 30*a* is driven by a drive belt 34 and associated drive motor 36 (FIG. 2) supported below the base plate 18. Roller 32*a* may be similarly driven but in an opposite rotational direction from drive roller 30*a*.

Positioned along the length of each of the primary conveyor belts 26 and 28 are a plurality of secondary conveyor belts, two of which are indicated generally at 40 and 42 in FIG. 2 adjacent conveyor belt 26. Each of the secondary conveyor belts 40 and 42, which may alternatively be termed diverter or sorter conveyor belts, defines a diverter or sorter station along an outer reach 26*a* of the primary conveyor belt 26 and is supported by three rollers, indicated at 44*a–c* and 46*a–c*, respectively. In the illustrated embodiment, the pairs of rollers 44*a,b* and 46*a,b* establish vertical conveyor belt reaches 40*a* and 42*a*, respectively, which lie in juxtaposed contacting relation with reach 26*a* of the primary conveyor belt 26, and form paths for conveyance of documents introduced into the system 10.

The rollers 44*c* and 46*c* are of equal diameter to the primary conveyor belt drive roller 30*a* and are rotatably driven by drive belt 34 so that the corresponding reaches 40*a* and 42*a* of the secondary conveyor belts travel at the same longitudinal speed as the primary conveyor belt reach 26*a*. The rollers 44*c* and 46*c* cooperate with their corresponding rollers 44*b* and 46*b* to establish a diverter reach for each of the secondary conveyor belts, indicated at 40*b* and 42*b*, respectively, which is angularly inclined to reach 26*a* of the primary conveyor belt 26. The rollers 44*c* and 46*c* are supported in a manner to allow movement transverse to their longitudinal axes and are biased by spring means (not shown) so as to maintain the corresponding belts 40 and 42 relatively taut during movement of the rollers 44*b* and 46*b*, as will be described. Preferably the conveyor belt support rollers employed in the document conveyor system 10 have crowned belt engaging surfaces to maintain the various conveyor belts in trained relation on the rollers.

The juxtaposed reaches 26*a*, 40*a* and 42*a* of the primary and secondary conveyor belts are operative to form a path to convey on-edge documents along the primary or main conveyor path of belt 26 when received from the accelerator rollers 12*a–d*. The reaches 40*a* and 42*a* of the secondary conveyor belts 40 and 42 are spaced along reach 26*a* of the primary conveyor belt 26 so that an open span 48 is created between the inclined reach of each secondary conveyor belt and the corresponding reach 26*a* of the primary conveyor belt.

The conveyor system 10 includes a substantially identical document diverter mechanisms at each of the diverter or sorter stations along the length of primary conveyor belt 26, such as defined by the secondary conveyor belts 40 and 42. One such diverter mechanism is indicated generally at 50 in FIGS. 1 and 2 in conjunction with secondary conveyor belt 40. It will be understood that a substantially identical document diverter mechanism would be employed with the secondary conveyor belt 42. Each document diverter mechanism 50 is operative in a first position to guide a non-diverted document along the open span 48 of the primary conveyor belt 26 immediately downstream from the juxtaposed reach of the corresponding secondary conveyor belt, such as 40*a*. Each document diverter mechanism is movable to a second position operative to divert a document from the primary conveyor path to a corresponding diverter path defined by the inclined reach of the corresponding secondary conveyor belt, such as 40*b*, and guide the diverted document along the inclined reach to a sweeper or stacker station, such as indicated generally at 52 in FIG. 1 cooperative with the secondary conveyor belt 40. As will be described, a third conveyor belt 56 and associated kicker arm means, indicated generally at 58, are operatively associated with each secondary conveyor belt to assist in moving a diverted document to the sweeper or stacker station and into a receiving bin or container.

Figure 3:
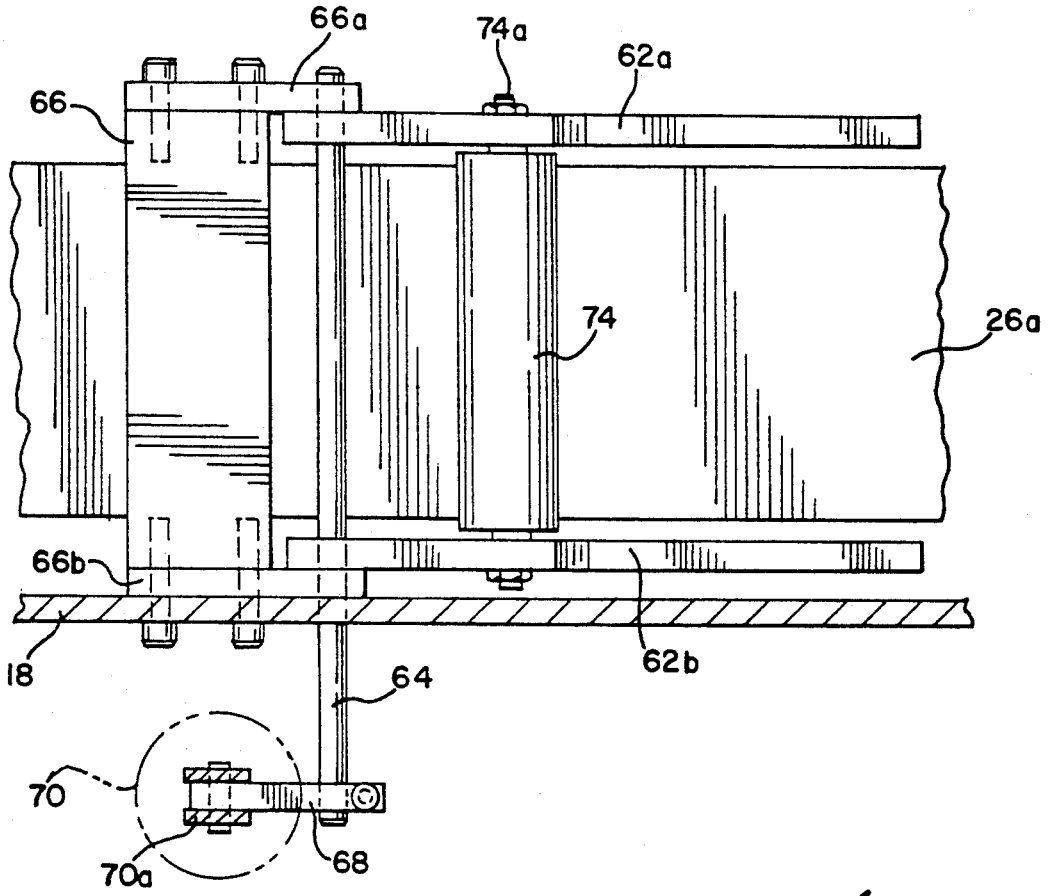
FIG. 3 is a fragmentary elevational view taken substantially along line 3—3 of FIG. 2.
Figure 4:
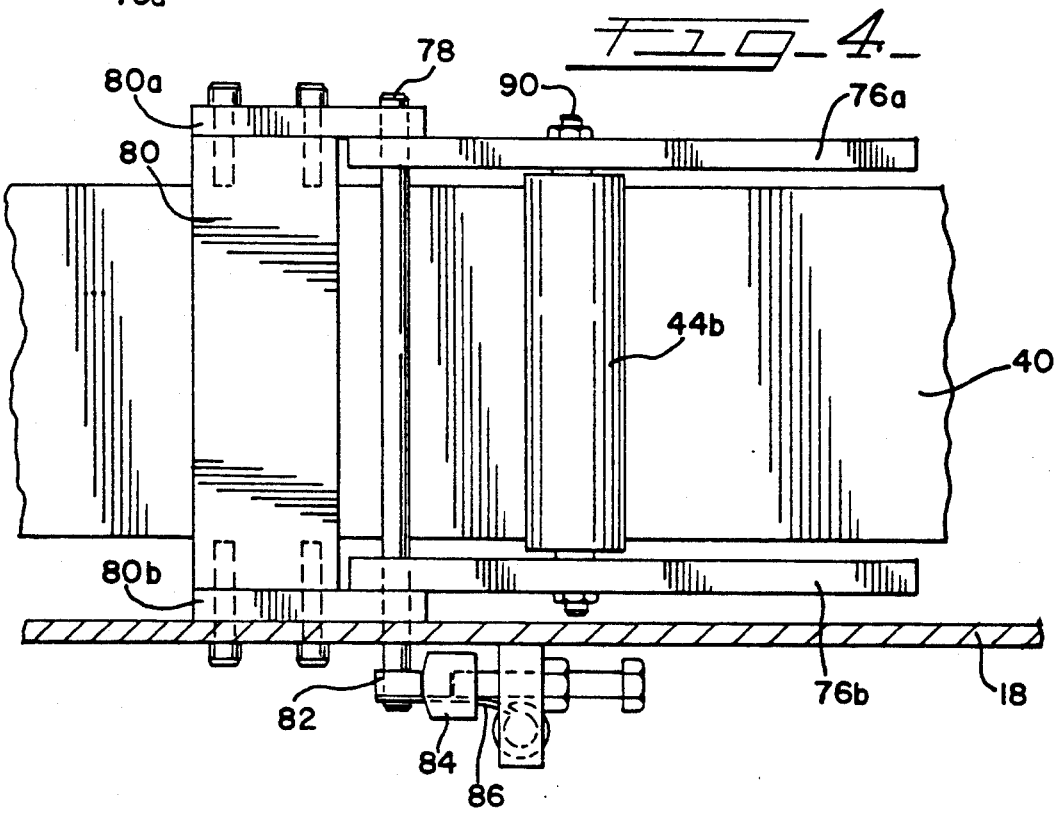
FIG. 4 is a fragmentary elevational view taken substantially along line 4—4 of FIG. 2.

Referring to FIGS. 3 and 4, taken in conjunction with FIGS. 1 and 2, the document diverter mechanism 50 includes a first pair of guide arms 62*a* and 62*b* which are fixed radially on a vertical support shaft 64 so as to lie above and below, respectively, the upper and lower marginal edges of primary conveyor belt 26. The support shaft 64 is supported for rotation about its longitudinal axis by upper and lower support arms 66*a* and 66*b*, respectively, which are fixed to opposite ends of a support bracket 66 secured to the base plate 18. The support shaft 64 extends below the base plate 18 and has a radial actuating arm 68 fixed to its lower end. The outer end of arm 68 is pivotally connected to a bifurcated rod 70*a* of an actuating solenoid 70, as shown in FIGS. 2 and 3. The solenoid 70 is adapted to receive a command or energizing signal from the reader station when a document entering the corresponding diverter station is to be diverted or sorted from the primary conveying path. Command signals from the reader station to solenoid 70 are controlled by sensor means in the form of a photocell, indicated schematically at 72 in FIG. 2, which enables energizing of solenoid 70 to pivot guide arms 62*a,b* from their normal retracted positions spaced inwardly from the plane of the primary belt reach 26*a*, as shown in solid lines in FIG. 2, to actuated positions wherein the guide arms 62*a,b* extend generally parallel to the inclined belt reach 40*b* of the secondary conveyor belt 40, as illustrated in phantom in FIG. 2, when the leading edge of a document is detected by the photocell 72. The photocell 72 also detects passage of the trailing edge of a diverted document to initiate de-energizing of the solenoid 70 and effect return of guide arms 62*a,b* to their non-pivoted or retracted positions. A time delay is provided in the control circuit for solenoid 70 so that the guide arms 62*a,b* are returned to their normal retracted positions after a predetermined period of time enabling the diverted document to move along the length of the inclined reach 40*b* of the secondary conveyor belt sufficiently to enter the nip between belts 40 and 56, as will be described.

The guide arms 62*a* and 62*b* carry an idler roller 74 having a vertical axle 74*a* extending through the guide arms such that the roller lies transverse to the longitudinal axis of the primary conveyor belt 26. With the guide arms 62*a,b* in their retracted positions spaced inwardly from the primary conveyor belt reach 26*a*, the roller 74 may lightly engage the inner surface of belt reach 26*a*.

The document diverter mechanism 50 includes a second pair of guide arms 76*a* and 76*b* (FIG. 4) which are fixed radially on a vertical support shaft 78 to lie slightly above and below the longitudinal marginal edges of the secondary conveyor belt 40 in similar fashion to the guide arms 62*a,b*. The support shaft 78 is similarly rotatably supported by and between upper and lower support arms 80*a* and 80*b* fixed on opposite ends of a support bracket 80 which is secured to the base plate 18. The support shaft 78 extends below the base plate and has a radial actuating arm 82 fixed thereto. The actuating arm 82 is biased against an adjustable stop 84 by a spring 86 which thereby biases the guide arms 76*a,b* to normal positions generally parallel to guide arms 62*a,b* but spaced outwardly from the plane of reach 26*a* of the primary conveyor belt 26, as shown in solid lines in FIG. 2.

The second pair of guide arms 76*a,b* carry the rotatable idler roller 44*b* through an axle 90 so that roller 44*b* is resiliently biased into transverse engagement with the inner surface of the secondary conveyor belt 40 by spring 86 to bias the secondary belt reach 40*a* into contact with the primary conveyor belt reach 26*a* when the guide arms 76*a,b* are in their normal retracted positions. In their retracted or non-actuated positions, the guide arms 76*a,b* extend substantially across the open span 48 of the primary conveyor belt reach 26*a* in relatively close proximity thereto downstream from the point at which the secondary conveyor belt 40 passes about idler roller 44*b*. In this condition, when a document is carried along the primary conveyor path by the primary conveyor belt reach 26*a* and the juxtaposed reach of a secondary conveyor belt, such as 40*a*, the document will be guided across the next downstream open span 48 of the primary conveyor belt by guide arms such as 76*a,b*. The spring 86 is selected to allow pivotal movement of the roller 44*b* about pivot axis 78 when a relatively thick document, such as ⅜ inch or greater, passes between rollers 74 and 44*b*, after which roller 44*b* and belt reach 40*a* bounce back against the primary conveyor belt reach 26*a*. The rollers 74 and 44*b* are spaced relative to their respective pivot axes 64 and 78 so that roller 44*b* bounces back against the primary conveyor belt and not against roller 74.

When the reader station "reads" a document and determines that the document is to be diverted from the primary conveyor path, such as at the diverter station defined by the secondary conveyor belt 40, it creates a command signal for the solenoid 70 as aforedescribed. When the photocell 72 detects the forward edge of the document to be diverted, solenoid 70 is energized to pivot the guide arms 62*a,b* to their actuated positions, as shown in phantom in FIG. 2. This pivotal movement of guide arms 62*a,b* effects a corresponding movement of roller 74 to move both of the juxtaposed reaches of the primary and secondary conveyor belts 26, 40 laterally away from their normal positions wherein they establish a portion of the rectilinear primary conveyor path. This lateral movement of the primary and secondary conveyor belts 26, 40 effects a corresponding movement of roller 44*b* and the associated guide arms 76*a,b* to positions as shown in phantom in FIG. 2 wherein the guide arms 76*a,b* are disposed inwardly of the inclined reach 40*b* of the secondary belt 40 and the guide arms 62*a,b* extend generally parallel to the belt reach 40*b* in relatively close relation thereto.

In their pivoted or actuated positions, the rollers 44*b* and 74 change the direction of the conveyor path established between the juxtaposed primary and secondary belt reaches 26*a* and 40*a* so as to initiate relatively gradual bending of a diverted document disposed between the juxtaposed belt reaches. Such movement of the juxtaposed belt reaches also reduces the angle of inclination between the inclined reach 40*b* of the secondary conveyor belt and the primary conveyor belt 26. Conversely, the included angle between reaches 40*a* and 40*b* of the secondary conveyor belt is increased. As a relatively thick inflexible document is carried between rollers 74 and 44*b*, it displaces roller 44*b* about the pivot axis 78 against the bias of spring 86 to further increase the included angle between belt reaches 40*a* and 40*b* and thereby further reduce the extent of bending which a diverted document undergoes as it is guided about pulley 44*b* by guide arms 62*a,b* to the inclined reach 40*b* of the secondary conveyor belt 40. This is particularly desirable when sorting relatively thick and inflexible documents which significantly resist bending.

It can thus be seen that with the guide arms 62*a,b* and 76*a,b* pivoted to divert a document from the primary conveyor path at the diverter station defined by the secondary conveyor belt 40, the document to be diverted undergoes bending while it is at least partially captured between the belt reaches 26*a* and 40*a*. That is, the leading edge of the diverted document engages the pivoted guide arms 62*a,b* and is guided about roller 44*b* and along the inclined reach 40*b* of conveyor belt 40 while the trailing portion of the document is positively engaged by the conveyor belt reaches 26*a* and 40*a*. When the trailing edge of the diverted document leaves the juxtaposed belt reaches 26*a* and 40*a* and passes around pulley 44*b*, it has a tendency to snap or fishtail in a direction away from the inclined belt reach 40*b*. The pivoted guide arms 62*a,b* prevent such fishtailing action and maintain substantially the full length of the diverted document against the belt reach 40*b*. As aforedescribed, the roller 44*c* is biased to maintain belt 40 relatively taut as the roller 44*b* undergoes pivotal movement with guide arms 76*a,b*.

As described, a document diverted from the primary conveyor path defined by the primary conveyor belt 26 at any of the diverter or sorter stations, such as defined by the secondary conveyor belt 40, is conveyed to a corresponding sweeper station, such a indicated at 52 for the diverter station illustrated in FIG. 1, or to a stacking assembly, by means of a third conveyor belt 56. Referring to FIGS. 1 and 2, taken in conjunction with FIG. 5, the conveyor belt 56 is movably supported on a pair of vertically disposed crowned rollers 94 and 96 so as to establish a reach 56*a* which lies in juxtaposed contacting relation with a portion of the inclined reach 40*b* of the secondary conveyor belt 40. As seen in FIG. 2, roller 94 is positioned to the left of roller 44*c*, whereby a portion of third conveyor belt 56 overlies and contacts a portion of reach 40*b* of belt 40. A nip 98 is created between roller 94 and belt reach 40*b* which engages and advances a document as the document is diverted along belt reach 40*b* when diverter arms 62*a* and 76*a* are in their actuated positions, as shown in phantom in FIG. 2.

The roller 96 is adapted to be rotatably driven by the drive belt 34 at the sam rotational speed but in an opposite rotational direction to the drive rollers 30*a* and 44*c*. The drive roller 96 preferably has a larger diameter belt drive surface than the drive surfaces of rollers 30*a* and 44*c* so that belt 56 is driven at a slightly greater longitudinal speed than belt 40. Such speed differential between conveyor belts serves to accelerate a document being conveyed along the inclined reach 40*b* of the secondary conveyor belt 40 as it passes through and exits from between the juxtaposed reaches of the belts 56 and 40. The increased speed or acceleration imparted to a document passing between the juxtaposed reaches of belts 40 and 56 causes the document to be carried by belt 56 to a stop position wherein the forward edge of the document engages an upstanding stop member 100 having a horizontal lead-in arm 100*a*. A relatively flexible horizontal guide arm 102 is supported at one end by an upstanding support 102*a* such that arm 102 extends substantially along the length of belt reach 56*a*. The guide arm 102 serves to maintain a document in upstanding relation against the belt reach 56*a* as the document engages stop 100, thereby preventing rebound as the document impacts the stop.

As illustrated in FIG. 2, the reach 56*a* of conveyor belt 56 lies a plane angularly inclined to the primary conveyor path defined by the primary conveyor belt reach 26*a*. The sweeper station 52 is oriented relative to the primary conveyor belt so as to sweep documents from the diverter station defined by conveyor belts 40 and 56 along a path transverse to the direction of the primary conveyor path. In this situation, an upright document disposed against the inclined reach 56*a* with its forward edge engaging the stop 100 is preferably reoriented to lie in a plane transverse to the longitudinal axis of the sweeper station 52 for proper feeding through the sweeper station. Such reorientation of a document disposed against the conveyor belt reach 56*a* is effected by kicker arm means 58 which moves the document laterally away from belt 56 to effect engagement of the lower edge of the document with feeder means in the form of one or more feed augers, one of which is indicated at 106 in FIG. 1, which initiate feeding of the document into conveying means within the sweeper station.

Figure 5:
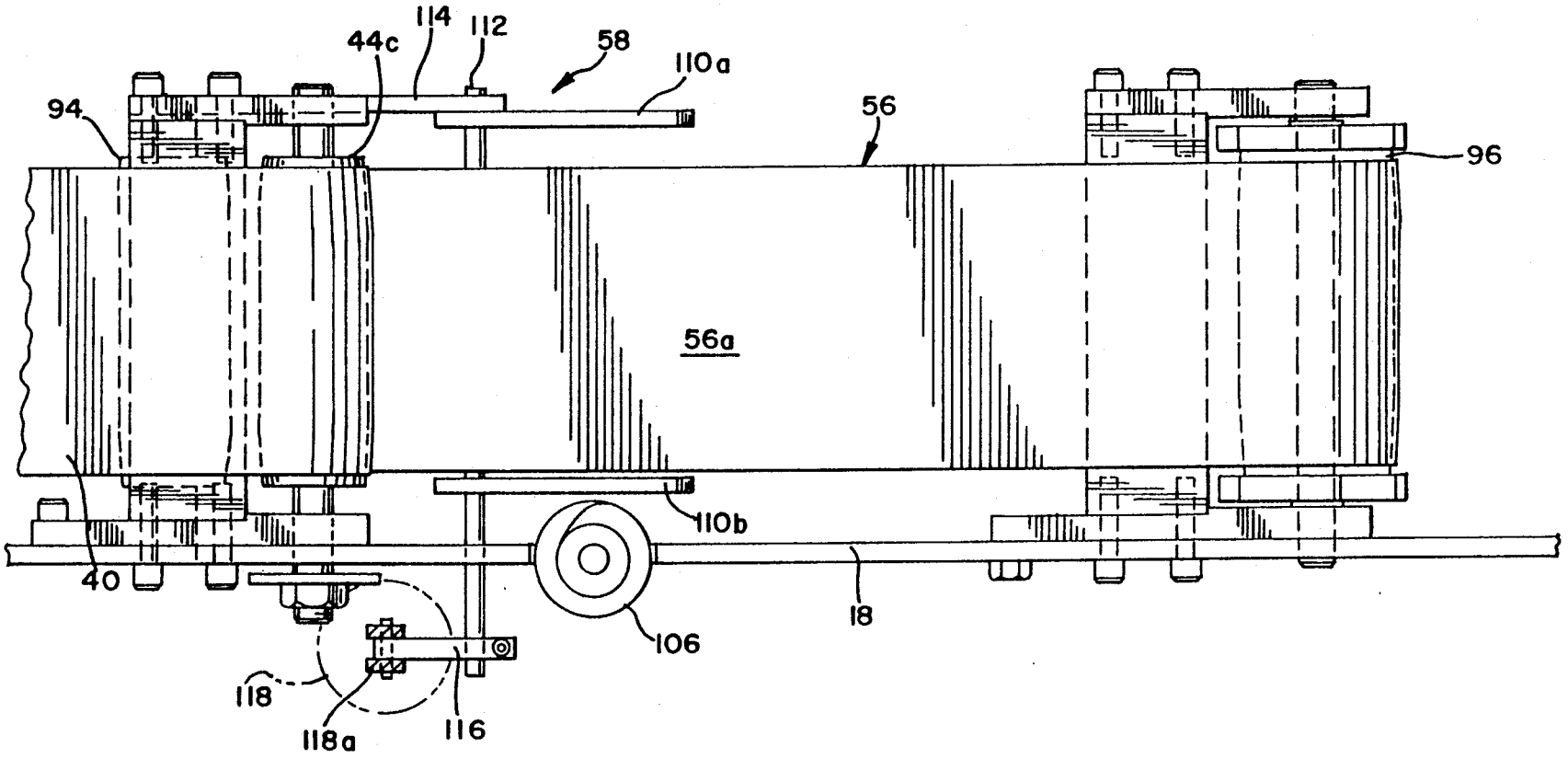
FIG. 5 is a fragmentary elevational view taken substantially along line 5—5 of FIG. 2.

Referring to FIG. 5 taken in conjunction with FIGS. 1 and 2, the kicker arm means 58 includes a pair of kicker arms 110*a* and 110*b* which are fixed in radial relation to a support shaft 112 so as to lie above and below the upper and lower marginal edges of belt 56. The support shaft 112 is supported by and between the base plate 18 and an upper support arm 114 which may be fixed to the upper end of the support axle for roller 94, as illustrated in FIGS. 1 and 2. The support shaft 112 extends below base plate 18 and has a radial actuating arm 116 fixed thereon. The outer end of the actuating arm 116 is pivotally connected to the bifurcated end of an actuating rod 118*a* of a conventional solenoid 118 which is suitably supported beneath the base plate 18. The solenoid actuating rod 118*a* is biased to a retracted position within the associated solenoid 118 by internal spring means so as to bias the kicker arms 110*a* and 110*b* to positions extending forwardly from the plane of the reach 56*a* of conveyor belt 56, as illustrated in solid lines in FIG. 2. Alternatively, biasing means (not shown) external to the solenoid 118 may be connected to the actuating arm 116 to bias the kicker arms to their forward positions.

The solenoid 118 is connected in an electrical control circuit having sensor means in the form of a photocell, indicated schematically at 120 in FIG. 2, which detects the leading and trailing edges of a document passing into the nip 98 between the juxtaposed reaches of the conveyor belts 40 and 56. Detection of the leading edge of a document by the photocell 120 causes energization of solenoid 118 to retract the kicker arms 110*a,b* to their retracted positions disposed rearwardly of belt reach 56*a*, as shown in phantom in FIG. 2, thus allowing the document leaving nip 98 and the inclined reach 40*b* of conveyor belt 40 to undergo unobstructed movement under the influence of belt 56 to a position wherein its leading edge abuts the stop 100. The solenoid control circuit is adapted to de-energize solenoid 188 after a predetermined time delay following detection of the trailing edge of the document by photocell 120, so that the solenoid spring biasing means rapidly retracts the solenoid actuating arm 118 and effects snap-action return of the kicker arms 110*a,b* to their forward positions. This snap-action movement of the kicker arms effects a corresponding "kicking" of the document disposed against belt reach 56*a* so as to move the lower edge of the document laterally away from the belt reach 56*a* sufficiently whereby the lower edge engages the auger 106. The auger 106 is supported so that a portion of its helical worm extends above the upper surface of base plate 18 to receive the lower edge of the document and feed the document into the sweeper station 52. Arm 102 retains the upper edge of the document in a somewhat vertical position as the auger 106 advances the lower edge of the document towards the sweeping station.

Referring to FIG. 1, the sweeper assembly 52 represents one embodiment of a sweeper assembly which may be utilized with the document conveying system 10. The sweeper assembly 52 is disclosed in greater detail in copending patent application, Ser. No. 07,676,156, filed Mar. 27, 1991, entitled SWEEPER ASSEMBLY FOR DOCUMENT CONVEYOR SYSTEM and which is incorporated herein by reference. Briefly, the sweeper assembly includes conveyor means in the form of a pair of endless conveyor belts 122 and 124 which are supported on respective pairs of rollers 126*a,b* and 128*a,b*. Rollers 126*a*, 126*b* and 128*b* are supported between upstanding support plates 130*a,b* and 132*a,b*. Roller 128*a* is supported on base plate 18 so that the uppermost end of the corresponding belt 124 is substantially coplanar with the upper surface of base plate 18.

The conveyor belts 122 and 124 are adapted to be driven at equal longitudinal speeds and have juxtaposed reaches defining a nip at the roller 128*a* to receive the lower edge of each successive document fed by the auger 106. The juxtaposed reaches of belts 122 and 124 positively grip and convey successive documents in a downwardly inclined path. A pair of document accelerator rollers 136*a* and 136*b* are fixed on a drive shaft 138 and cooperate with a corresponding pair of nip rollers, one of which is indicated at 140*a*, to define nips which receive successive documents fed from the conveyor belts 122 and 124. The pairs of accelerator and nip rollers accelerate movement of successive documents into a receiving container 142 in stacked relation to facilitate subsequent processing.

Thus, in accordance with the present invention, a document handling conveyor system particularly adapted to handle large documents as well as conventional sized documents is provided wherein one or more sorter or diverter stations are disposed along a primary conveyor path and are operative in response to command signals to divert selected documents from the primary conveyor path for transfer to a stacker station or the like. The document handling conveyor system in accordance with the invention finds particular application in sorting relatively thick and inflexible documents through the use of unique guide arm means to guide the diverted documents along diverter reaches of corresponding secondary conveyor belts while preventing fishtailing of the documents as they undergo bending in the diverting path.

While a preferred embodiment of the present invention has been illustrated and described, it will be understood to those skilled in the art that changes and modifications may be made therein without departing from the invention and its broader aspects. Various features of the invention are defined in the following claims.

What is claimed is:

1. In a conveyor system for conveying generally flat documents on-edge, said system including a primary conveyor belt defining a primary conveyor path, at least one secondary conveyor belt having a first reach disposed in juxtaposed relation to a reach of said primary conveyor belt, means for effecting movement of said primary and secondary conveyor belts to convey a document received on-edge between said juxtaposed belt reaches along said primary path, said secondary conveyor belt having a second reach inclined to said primary conveyor belt so as to establish an open span along said primary conveyor belt immediately downstream from said juxtaposed belt reaches; the combination therewith comprising document diverter means including guide arm means supported adjacent said juxtaposed reaches of said primary and secondary conveyor belts, said guide arm means being selectively movable between a first position operative to guide a non-diverted document along said open span of said primary conveyor belt, and a second position operative to move said juxtaposed belt reaches from said primary conveyor path to divert and guide a document along the inclined reach of said secondary conveyor belt.

2. A conveyor system as defined in claim 1 wherein said first reach of said secondary conveyor belt is adapted to engage an outer surface of said primary conveyor belt, said guide arm means including a first elongated guide arm supported to extend generally parallel to and spaced from the opposite inner surface of said primary conveyor belt downstream from said juxtaposed belt reaches, and a second elongated guide arm supported to extend generally parallel to said first guide arm in spaced relation to said outer surface of said primary conveyor belt, said first and second guide arms being cooperative in first positions to guide a non-diverted document along said open span, and actuating means responsive to a command signal to selectively move said first and second guide arms to second positions operative to divert a document from said primary conveyor path to said inclined reach of said secondary conveyor belt.

3. A conveyor system as defined in claim 2 including sensor means for detecting the leading edge of a document being conveyed along said primary conveyor path between said juxtaposed belt reaches, and wherein said actuating means is enabled for response to a command signal by detection of the leading edge of a document by said sensor means.

4. A conveyor system as defined in claim 1 wherein said guide arm means includes a pair of elongated guide arms pivotally supported adjacent said juxtaposed belt reaches for selective movement between a first position enabling movement of a document along said primary conveyor path downstream from said juxtaposed belt reaches, and a second position operative to divert a document from said primary conveyor path and guide the document along the inclined reach of said secondary conveyor belt, said guide arms carrying a roller disposed transverse to said primary conveyor belt and operative to move said juxtaposed belt reaches laterally to divert the path traversed by a document when said pair of guide arms is in said second position.

5. A conveyor system as defined in claim 4 including a second pair of elongated guide arms pivotally supported in generally parallel relation to said first pair of guide arms, said second pair of guide arms being movable between a first position operative to guide a non-diverted document along said open span of said primary conveyor belt, and a second position enabling movement of a diverted document along said inclined reach of said secondary conveyor belt, and means resiliently biasing said second pair of guide arms to said first position.

6. A conveyor system as defined in claim 5 including stop means cooperative with said second pair of guide arms to establish said first position of said second guide arms.

7. A conveyor system as defined in claim 1 wherein said primary conveyor belt comprises an endless conveyor belt having an outer document engaging surface juxtaposed to said first reach of said secondary conveyor belt and having upper and lower marginal edges, said guide arm means including a first pair of guide arms disposed above and below said marginal edges of said primary conveyor belt and carrying a roller therebetween transverse to said primary conveyor belt, said first pair of guide arms and said roller being pivotally movable between a first position wherein said roller is spaced from said primary conveyor belt and a second position wherein said roller engages said primary conveyor belt in a manner to move said juxtaposed belt reaches laterally and change the path traversed by a document being conveyed by said juxtaposed belt reaches.

8. A conveyor system as defined in claim 7 wherein said first pair of guide arms is operative in its said second position to guide a diverted document along said inclined reach of said secondary conveyor belt.

9. A conveyor system as defined in claim 7 including actuating means operatively associated with said first pair of guide arms to effect movement thereof between said first and second positions in response to command signals applied to said actuating means.

10. A conveyor system as defined in claim 9 including sensor means adapted to detect the leading and trailing edges of a document traversing said primary conveyor path between said juxtaposed reaches of said conveyor belts, said sensor means being operative to enable application of a command signal to said actuating means when the leading edge of a predetermined document is detected, and terminate said command signal when the trailing edge of said predetermined document is detected.

11. A conveyor system as defined in claim 7 wherein said guide arm means includes a second pair of guide arms pivotally supported on a common pivot axis and carrying a second roller in engaging relation with said secondary conveyor belt, said second pair of guide arms being operative in a first position to guide a non-diverted document through said open span of said primary conveyor belt when said first pair of guide arms is in its said first position, said second roller being responsive to said lateral movement of said belt reaches to effect pivotal movement of said second pair of guide arms to a second position enabling movement of a diverted document along said inclined reach of said secondary conveyor belt.

12. A conveyor system as defined in claim 11 including actuating means operative in response to a command signal to move said first pair of guide arms from said first to said second position.

13. A conveyor system as defined in claim 12 wherein said actuating means comprises a solenoid.

14. A conveyor system as defined in claim 11 including means resiliently biasing said second pair of guide arms toward said first position such that said second roller is biased against said secondary conveyor belt in a manner to establish said first reach thereof.

15. A conveyor system as defined in claim 14 wherein said second pair of guide arms and said second roller are pivotally mounted to said conveyor system to enable passage of documents of various thicknesses between said juxtaposed belt reaches.

16. In a conveyor system for conveying generally flat documents on-edge, said system including a primary conveyor belt defining a primary conveyor path, at least one secondary conveyor belt having a first reach disposed in juxtaposed relation to a reach of said primary conveyor belt, means for effecting movement of said primary and secondary conveyor belts to convey a document received on-edge between said juxtaposed belt reaches along said primary path, said secondary conveyor belt having a second reach inclined to said primary conveyor belt so as to establish an open span along said primary conveyor belt immediately downstream from said juxtaposed belt reaches; the combination therewith comprising document diverter means operative in a first position to guide a document along the open span of said primary conveyor belt after leaving said juxtaposed belt reaches, and movable in response to a command signal to a second document diverter position operative to move both of said juxtaposed belt reaches laterally from said primary conveyor path and guide a diverted document onto said inclined reach of said secondary conveyor belt.

17. A conveyor system as defined in claim 16 including a third conveyor belt having a belt reach cooperative with said inclined reach of said secondary conveyor belt to receive a diverted document for transfer to a stacker station or the like.

18. A conveyor system as defined in claim 17 wherein said stacker station is adapted to sweep documents into a container along a predetermined path, said reach of said third conveyor belt being inclined to said predetermined path, and including kicker arm means operatively associated with said third conveyor belt and operative to reorient a document disposed against said third conveyor belt reach to a position lying generally transverse to said predetermined path.

19. A conveyor system as defined in claim 18 wherein said kicker arm means includes at least one kicker arm biased to a first position extending forwardly from said reach of said third conveyor belt, and including actuating means selectively operable to move said kicker arm to a second position enabling movement of a document along said third conveyor belt reach, said kicker arm being adapted for snap-action movement to effect said reorientation of a document disposed against said third conveyor belt reach.

20. A conveyor system as defined in claim 19 including feeder means adapted to receive the bottom edge of a document reoriented by said kicker arm means so as to feed the document toward said container.

21. A conveyor system as defined in claim 20 wherein said stacker station includes feeder conveyor means including a pair of conveyor belts defining a nip adapted to receive a document from said feeder means and convey said document toward said container.

22. A conveyor system as defined in claim 21 including accelerator roller means positioned to receive a document from said feeder conveyor means and effect accelerated movement of said document into a receiving container.

23. A conveyor system as defined in claim 18 including actuator means operatively associated with said kicker arm means in a manner to effect movement thereof between a first position extending outwardly of said third conveyor belt reach and a second position disposed rearwardly of said second conveyor belt reach, and including means biasing said kicker arm means to said first position.

24. A conveyor system as defined in claim 19 including sensor means operatively associated with said actuating means to effect movement of said kicker arm from said first to said second positions when the leading edge of a document received from said inclined reach of said secondary conveyor belt is detected.

25. A conveyor system as defined in claim 24 wherein said sensor means is operative to sense the trailing edge of a document conveyed from said inclined reach of said secondary conveyor belt to said third conveyor belt and effect deenergizing of said actuator means so as to enable said snap-action movement of said kicker arm.

26. A method for diverting flat documents from a primary conveyor path along which the documents are conveyed in generally upstanding on-edge relation, the primary conveyor path being defined at least in part by a vertically disposed reach of a primary conveyor belt and a juxtaposed reach of a secondary conveyor belt having a diverter reach inclined to the primary conveyor path and along which diverted documents are conveyed to a stacking bin or the like, said method comprising the steps of simultaneously moving said juxtaposed reaches of said primary and secondary conveyor belts laterally when a document to be diverted is being conveyed therebetween so as to change the path traversed by the document from the direction of the primary path toward the inclined reach of the secondary conveyor belt, and guiding the diverted document onto the inclined reach while the document is at least partially griped between the laterally moved juxtaposed belt reaches, said step of guiding the diverted document onto the inclined reach of the secondary conveyor belt comprising engaging the leading edge of the diverted document with at least one guide arm disposed generally parallel to the inclined reach.

27. The method as defined in claim 26 wherein said step of engaging the leading edge of the diverted document with a guide arm to guide the diverted document onto the inclined reach of the secondary conveyor belt includes maintaining the guide arm in position to prevent fishtailing of the document as the document fully exits the juxtaposed reaches of said primary and secondary conveyor belts.

* * * * *